US005395264A

United States Patent [19]

Keith

[11] Patent Number: 5,395,264

[45] Date of Patent: Mar. 7, 1995

[54] ELECTRICAL CONNECTOR/ADAPTER

[76] Inventor: Carlton L. Keith, 11830 Buckhorn Rd., Chesterfield, Va. 23832

[21] Appl. No.: 13,932

[22] Filed: Feb. 5, 1993

[51] Int. Cl.[6] ..... H01R 11/00

[52] U.S. Cl. ..... 439/502; 439/668

[58] Field of Search ..... 439/365, 369, 502, 638, 439/639, 653, 655, 668, 669

[56] References Cited

U.S. PATENT DOCUMENTS

| | | | |
|---|---|---|---|
| 507,946 | 10/1893 | DePoele et al. | 439/502 X |
| 1,735,856 | 11/1929 | Greene | 439/669 X |
| 1,781,958 | 11/1930 | Schellenger | 439/669 |
| 2,186,578 | 1/1940 | Doughman | 439/502 X |
| 3,538,484 | 11/1970 | Passafiume | 439/502 X |
| 4,047,786 | 9/1977 | Gietzen | 439/655 |
| 4,077,690 | 3/1978 | Koether | 439/923 X |
| 4,900,270 | 2/1990 | Edwards et al. | 439/502 |
| 5,018,044 | 5/1991 | Weiss | 439/669 X |
| 5,118,301 | 6/1992 | Bentivolio | 439/638 X |

FOREIGN PATENT DOCUMENTS

| | | | |
|---|---|---|---|
| 1445657 | 6/1966 | France | 439/365 |

*Primary Examiner*—Khiem Nguyen
*Attorney, Agent, or Firm*—Norman B. Rainer

[57] ABSTRACT

A kit of electrical connectors enables an ordinary AC extension cord to conduct an amplified audio electrical signal between components of an audio system such as an amplifier and loudspeakers. The kit includes connectors adapted to engage the male and female ends of the extension cord. Each connector has a housing body, and is further provided with a standard audio-type connector such as a quarter inch jack post or XLR type fitting. Electrical wires extending through the housing body join the AC connector contact terminals to the audio connector contact terminals.

2 Claims, 1 Drawing Sheet

ELECTRICAL CONNECTOR/ADAPTER

BACKGROUND OF THE INVENTION

1. Field of the Invention

This invention relates to electrical connectors, and more particularly concerns an adapter system permitting the passage of an amplified audio electrical signal through a standard AC extension cord.

2. Description of the Prior Art

Numerous electrical connectors have been disclosed in the prior art, and various adapters have been employed in attempts to mate mismatched electrical connectors. For example, U.S. Pat. No 4,856,999 to Flohr discloses an electrical adapter of pentaprism configuration having five different plug pin arrangements to accommodate different plugging systems. The adapter has a revolving body which has an area on the top or bottom surface having plugging sockets for two or more systems. The body may be rotated to adapt a plug mating with any of the socket configurations to a receptacle mating with any of the five pin configurations. When rotated to a particular set of pins, all other pin sets are devoid of voltage.

U.S. Pat. No. 4,787,862 to Lee discloses an apparatus for electrically connecting two audio components utilizing different sized conductors in which first and second connector blocks have first terminals for respectively connecting the conventional terminals of the audio components. Each connector block has a plurality of additional terminals electrically connected to the first terminal. A plurality-of electrical conductors, having different electrical current transfer characteristics, are connected between two corresponding additional terminals of the connector blocks to complete the connection.

U.S. Pat. No. 4,585,286 to Par discloses a plug adapter which converts a three prong male household plug to a three-prong male OSHA twistlock connector, and vise versa. The adapter has a cylindrical body with a block having a set of prongs adapted to fit a twist lock receptacle, and a set of prongs adapted to fit a standard three socket receptacle. The block is adapted to reciprocate between two end plates, each having a plurality of apertures to permit passage of the respective set of prongs. When one set of prongs is extended, the opposite plate serves as a receptacle to receive a mating male connector.

Various connectors have been disclosed which have interchangeable socket and pin arrangements. For example, U.S. Pat. No. 3,885,849 to Bailey et el. discloses an electrical connector with interchangeable components. The connector consists of a housing and different types of molded male and female inserts which can be readily assembled with said housing and removed therefrom so that different configurations may be obtained. Another modular connector is disclosed in U.S. Pat No. 4,158,473 to Shearer. This connector consists of a plastic cylindrical plug and receptacle, each having a plurality of cavities extending longitudinally therethrough. The cavities are adapted to receive a corresponding plurality of plastic modules. Each module has a plurality of holes for receiving electrical contact pins or sockets. The modules have locking tabs which lock the modules in place.

U.S. Pat. No. 4,900,270 to Edwards et el. discloses a cable adapter assembly that allows a plurality of plugs to be used with a plurality of sockets. The arrangement consists of at least two cable members, each having a plug and socket separated by an electric cord wherein the plug and socket on any given cable member are of distinctly distinct configurations. This assembly is designed to permit an operator to quickly adapt a given electric plug from an appliance to a particular wall outlet.

Although the aforesaid electrical connectors each have specific utility, none specifically address the problem of utilizing a standard extension cord to carry audio signals between audio components which have jack-type connectors. It is common practice in the audio technical field to connect multiple amplifiers, microphones, musical instruments, etc. with coaxial or two conductor cables having quarter inch jack-type socket and post connectors of standard XLR type connectors characterized in having flat faces of circular perimeter with three protruding circular posts in the case of the male connector, and three matching circular recesses in the case of the female connector. Of said three posts and recesses, one post and recess pair serves to establish a ground circuit. Consequently, the expression "XLR" is an acronym for ground, left, right The male member is generally provided with a sleeve that fits upon the female member.

Often in setting up such equipment in new locations technicians will "run short" of cable length required to reach between components. Often three-conductor household plug type extension cords for alternating current (AC) are readily available, and several such cords may be connected end-to-end to make longer connections. Furthermore, extension cords usually have larger diameter conductors, which promote better quality audio signal transmission over long distances. This efficiency also reduces power loss and promotes heat dissipation of the cord due to the lower resistance of the cord.

Other advantages of using the AC extension cord as opposed to other cables are 1) the ease of phase correction by simply reversing the plug, 2) the greater durability of the AC cords, 3) the capability of using standard multi-outlet connector strips for multiple connections and 4) AC extension cords are inexpensive and easily procured at a hardware store rather than at an audio or electrical supplier.

It is therefore an object of the present invention to provide an electrical connector adapter system capable of utilizing a standard (AC) electrical extension cord to interconnect audio devices having quarter inch post and socket connectors.

It is another object of the present invention to provide an electrical connector adapter system capable of utilizing a standard electrical extension cord to interconnect audio devices having type XLR plug and socket connectors.

It is a further object of this invention to provide a system of the aforesaid nature in which the component parts are simply and quickly interchanged.

It is yet another object of this invention to provide a system of the aforesaid nature which is durable and amenable to low cost manufacture.

These and other beneficial objects and advantages will be apparent from the following description.

SUMMARY OF THE INVENTION

The above and other beneficial objects and advantages are accomplished in accordance with the present invention by an electrical connection adapter kit adapted for use with an OSHA standard AC extension cord having three insulated conductor strands extending through an insulated sheathing and terminating in male and female extremities, said male extremity having a standard three prong plug, said female extremity having a standard three socket receptacle, said kit comprised of:

a) at least one quarter-inch-male-to-AC-male connector having a housing body having first and second extremities, said first extremity having three elongated metal prongs extending therefrom and adapted to mate with said female (AC) extension cord receptacle, said second extremity having a standard quarter inch audio post connector extending therefrom, said post having at least two distinct electrically conductive contact zones, said housing body containing electrical connection means communicating between said metal prongs and, the contact zones of said post, b) at least one quarter-inch-male-to-AC-female connector having a housing body having first and second extremities, said first extremity having three elongated sockets adapted to receive said male (AC) extension cord plug and containing metal contacts adapted to make electrical connection with said plug, said second extremity having a standard quarter inch audio post connector longitudinally extending therefrom, said post having at least two distinct electrically conductive contact zones, said housing body containing electrical connector means communicating between said metal contacts and the contact zones of said post, c) at least one XLR-male-to-AC-male connector comprised of an elongated cable containing at least two strands of insulated electrical conductors, said cable having an AC extremity provided with a standard male AC extension cord plug having three prongs,and an XLR extremity provided with a standard male XLR type plug having multiple connector pins, said strands of electrical conductors achieving electrical connection between said AC plug prongs and the associated pins of said XLR plug, and d) at least one XLR-female-to-AC-female connector comprised of an elongated cable containing at least two strands of insulated electrical conductors, said cable having an AC extremity provided with a standard female AC extension cord receptacle having three sockets, and an XLR extremity provided with a standard female XLR receptacle having multiple connector sockets, said strands of electrical conductors achieving electrical connection between said AC receptacle sockets and the associated sockets of said XLR receptacle, whereby, the various connectors may be engaged with plug and receptacle ends of said AC extension cord to connect between female quarter-inch sockets and either male or female XLR connectors.

In a preferred embodiment, the housing bodies may be molded from thermoplastic resin in an injection molding process. In alternative embodiments, the bodies may be in the form of commercially available AC plug and receptacle cord end fittings such as those manufactured by Hubhal or Leviton, in which case the cord clamping member of the cord end would embrace the proximal extremity of the quarter inch post, thereby allowing the distal extremity of the post to be inserted into a quarter inch socket.

In alternative embodiments, connectors may be adapted to interconnect between various configurations of:

1) quarter-inch male and female connectors,
2) male and female type XLR connectors,
3) AC three prong male and female connectors,
4) male and female RCA standard type connectors,
5) male and female 3.5 mm mini type connectors,
6) male and female banana plug connectors,
7) male and female type TRS (tip, ring, sleeve) connectors.

In some embodiments, the conductors may be crossed between respective end connectors in order to reverse the phase of the audio signal.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
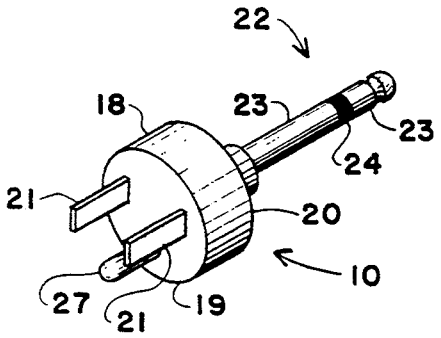
FIG. 1 is a perspective view of an embodiment of the quarter-inch-male -to-AC-male connector of the present invention.
Figure 2:
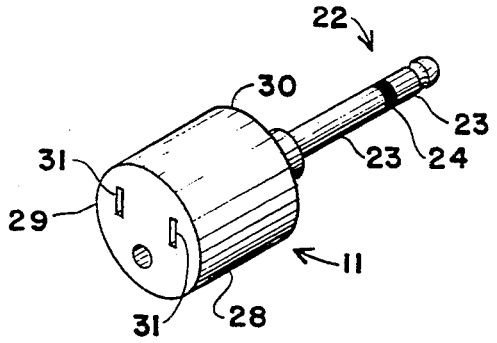
FIG. 2 is a perspective view of an embodiment of the quarter-inch-male -to-AC-female connector of the present invention.
Figure 3:
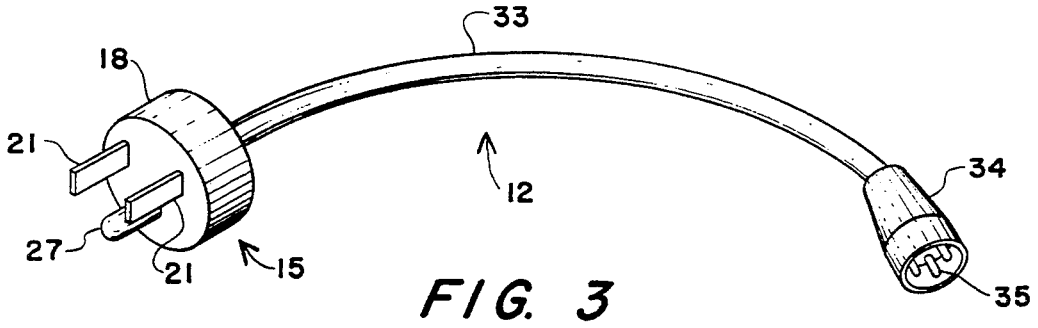
FIG. 3 is a perspective view of an embodiment of the XLR—male-to-AC-male connector of the present invention.
Figure 4:
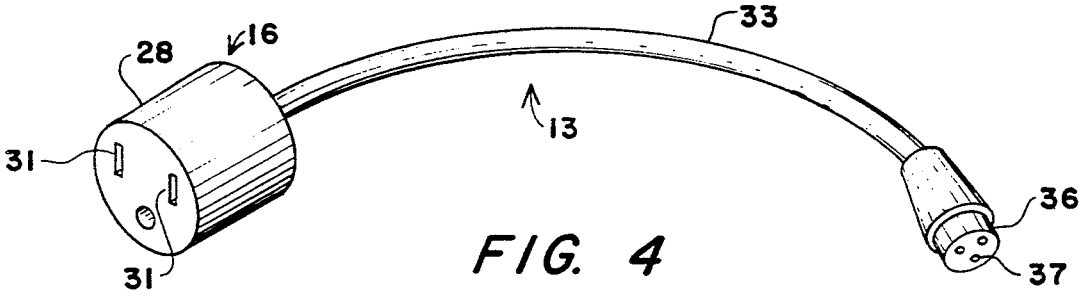
FIG. 4 is a perspective view of an embodiment of the XLR—female-to-AC-female connector of the present invention.

Referring to FIGS. 1–6, an embodiment of the kit of the present invention is shown comprised of an assemblage of at least one each of connector 10 of FIG. 1, connector 11 of FIG. 2, connector 12 of FIG. 3 and connector 13 of FIG. 4.

Figure 5:
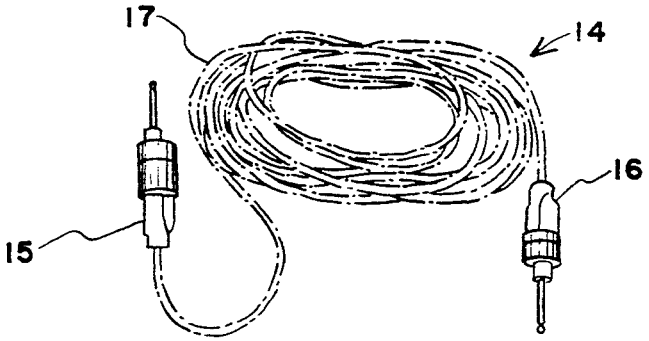
FIG. 5 is a perspective view of a standard AC extension cord with male and female quarter inch adapters connected to the respective AC connectors.

The utilization of connectors 10 and 11 are shown in FIG. 5 association with a standard AC extension cord 14 having male plug 15 and female socket 18. Three strands of insulated conductor wire (not shown) are disposed within the outer sheath of cable 17 which extends between plug 15 and socket 16.

Connector 10 is comprised of housing body 18 fabricated of electrically non-conductive material by a molding operation, said housing body having opposed first and second extremities, 19 and 20 respectively. Said first extremity 19 has three elongated metal prongs 21 extending outwardly therefrom. Two of said prongs 21, of flat rectangular contour, are disposed in facing relationship and are intended to conduct alternating current. The third prong 27, located below said facing prongs, is a ground line terminal. Prongs 21 are adapted to mate with the female receptacle 16 of standard AC extension cord 14.

Second extremity 20 has a standard quarter inch diameter audio post connector 22 extending from body 18 in a direction diametrically opposite from the direction of extension of prongs 21.

Figure 6:
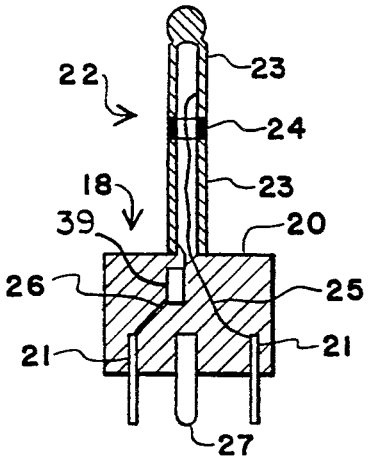
FIG. 6 is an electrical schematic of the connector of FIG. 1.

Connector post 22 has two distinct electrically conductive contact sleeve zones 23 axially spaced apart by an insulative separator 24. As shown in FIG. 6, the sleeve 23 at the free or distal extremity of post 22 communicates with one of the flat prongs 21 by way of conductor wire 25 that extends through the center of post 22 and through body 18. Similarly, the sleeve 23 at the attached, or proximal extremity of plug 22 communicates with the other flat prong 21 by way of conductor wire 26. The rounded ground wire prong 27 is essentially not utilized in this embodiment. In embodiments wherein post 22 has three contact sleeves, the third sleeve would become electrically joined to the ground wire prong.

Connector 11 is comprised of a housing body 28 generally similar to that employed in connector 10 and having opposed first and second extremities, 29 and 30, respectively. Said first extremity 29 contains three elongated sockets 31 containing electrical contacts and adapted to receive the male prongs of standard AC extension cord plug 15. Second extremity 30 has a standard quarter inch audio post connector 22 as employed in connector 10. The sleeve zones 23 of connector 22 communicate by conductor wires with the contacts of sockets 31 in a manner similar to that of connector 10.

Connector 12 is comprised of cable 33 containing at least two strands of insulated electrical conductors (not shown). A first extremity of cable 33 is provided with a standard male AC extension cord plug having prongs 21 emergent from a housing body 18. The two strands of electrical conductors join with prongs 21 by conductor wires in substantially the same manner as shown in FIG. 6. The second extremity of cable 33 is provided with a standard XLR male plug 34 having connector pins 35. Two of pins 35 are in electrical communication with separate strands of conductors in cable 33.

Connector 13 is comprised of cable 33 containing at least strands of insulated electrical conductors (not shown). A first extremity of cable 33 is provided with a standard female AC extension cord socket 16. The two strands of electrical conductors join with contacts within two sockets 31 in receptacle 16. The second extremity of cable 33 is provided with a standard female XLR receptacle 36 containing multiple connector sockets 37. Two of sockets 37, corresponding to the pins 35 of XLR male plug 34, are in electrical communication with said strands.

In preferred embodiments, the connectors, particularly the male components, are provided with a safety fuse or equivalent means to prevent passage of line current through the connector due to inadvertent use. An example of a fuse 39 is illustrated in FIG. 6.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An electrical connection adapter kit adapted for use with a standard AC extension cord having three insulated conductor strands extending through an insulated sheathing and terminating in male and female extremities, said male extremity having a standard three prong plug, said female extremity having a standard three socket receptacle, said kit comprised of:

a) at least one quarter-inch-male-AC-male connector having a housing body having first and second extremities, said first extremity having three elongated metal prongs extending therefrom and adapted to mate with said female (AC) extension cord receptacle, said second extremity having a standard quarter inch audio post connector extending therefrom, said post having at least two distinct electrically conductive contact zones, said housing body containing electrical connection means communicating between said metal prongs and the contact zones of said post, and b) at least one quarter-inch-male-to-AC-female connector having a housing body having first and second extremities, said first extremity having three elongated sockets adapted to receive said male (AC) extension cord plug and containing metal contacts adapted to make electrical connection with said plug, said second extremity having a standard quarter inch audio post connector longitudinally extending therefrom, said post having at least two distinct electrically conductive contact zones, said housing body containing electrical connection means communicating between said metal contacts and the contact zones of said post, whereby the various connectors may be engaged with plug and receptacle ends of said AC extension cord to connect between female quarter inch sockets.

2. An electrical connection adapter kit adapted for use with a standard AC extension cord having three insulated conductor strands extending through an insulated sheathing and terminating in male and female extremities, said male extremity having a standard three prong plug, said female extremity having a standard three socket receptacle, said kit comprised of:

a) at least one XLR-male-to-AC-male connector comprised of an elongated cable containing at least two strands of insulated electrical conductors, said cable having an AC extremity provided with a standard male AC extension cord plug having three prongs, and an XLR extremity provided with a standard male XLR type plug having multiple connector pins, said strands of electrical conductors achieving electrical connection between said AC plug prongs and the associated pins of said XLR plug, and b) at least one XLR-female-to-AC-female connector comprised of an elongated cable containing at least two strands of insulated electrical conductors, said cable having an AC extremity provided with a standard female AC extension cord receptacle having three sockets, and an XLR extremity associated with a standard female XLR receptacle having multiple connector sockets, said strands of electrical conductors achieving electrical connection between said AC receptacle sockets and the associated sockets of said XLR receptacle, whereby, the various connectors may be engaged with plug and receptacle ends of said AC extension cord to connect between male and female XLR connectors.

* * * * *